US005751218A

United States Patent [19]

Winterble et al.

[11] Patent Number: 5,751,218

[45] Date of Patent: May 12, 1998

[54] SMOKE DETECTOR HOUSING FOR IMPROVED SMOKE COLLECTION

[75] Inventors: Charles Winterble, Princeton; Wayne Nelson, Maynard; Lawrence G. Stanley, Templeton, all of Mass.

[73] Assignee: Simplex Time Recorder Company, Gardner, Mass.

[21] Appl. No.: 684,947

[22] Filed: Jul. 19, 1996

[51] Int. Cl.[6] ..... G08B 23/00

[52] U.S. Cl. ..... 340/693; 340/628; 340/630

[58] Field of Search ..... 340/693, 628, 340/629, 630; 250/573; 356/438; D10/106

[56] References Cited

U.S. PATENT DOCUMENTS

| | | | |
|---|---|---|---|
| D. 204,916 | 5/1966 | Blevins | D71/1 |
| D. 215,039 | 8/1969 | Nagao | D72/1 |
| D. 215,040 | 8/1969 | Nagao | D72/1 |
| D. 226,539 | 3/1973 | Fearsall | D72/1 |
| D. 235,629 | 7/1975 | Steele et al. | D10/106 |
| D. 235,857 | 7/1975 | Hart | D10/106 |
| D. 238,057 | 12/1975 | Pearsall et al. | 340/628 |
| D. 241,824 | 10/1976 | Mackay | D10/106 |
| D. 244,362 | 5/1977 | Mayer | D10/106 |
| D. 247,164 | 2/1978 | Lowell | D10/106 |
| D. 253,525 | 11/1979 | Wilson | D10/106 |
| D. 269,161 | 5/1983 | Fenne | D10/106 |
| D. 269,331 | 6/1983 | Fenne | D10/106 |
| D. 271,287 | 11/1983 | Fenne | D10/106 |
| D. 275,187 | 8/1984 | Skarman | D10/104 |
| D. 276,417 | 11/1984 | Fenne | D10/106 |
| D. 279,872 | 7/1985 | Thornton, Jr. et al. | D10/106 |
| D. 283,407 | 4/1986 | Fenne | D10/104 |
| D. 308,836 | 6/1990 | Fenne | D10/106 |
| D. 316,828 | 5/1991 | Amemiya et al. | D10/104 |
| D. 318,437 | 7/1991 | Kojima et al. | D10/104 |
| D. 319,798 | 9/1991 | Hatano | D10/104 |
| D. 332,231 | 1/1993 | Akimoto et al. | D10/104 |
| D. 339,078 | 9/1993 | Behlke | D10/104 |

(List continued on next page.)

OTHER PUBLICATIONS

Simplex Time Recorder Company, Pamphlet, "TrueAlarm Fire Alarm Systems," Publication S4098–0003–8, 4 pps, Jan., 1995.

Simplex Time Recorder Company, Pamphlet, "Multi–Application Peripherals and Accessories,", Publication S4098–0007–4, 4 pps, Apr. 1995.

Simplex Time Recorder Company, Leaflet, "Multi–Application Peripherals and Accessories," Publication S2098–0048–9, 1 p., Mar. 1995.

Simplex Time Recorder Company, Leaflet, "Multi–Application Peripherals and Accessories," Publication S2098–0049–6, 1 p., Feb., 1994.

Simplex Time Recorder Company, Leaflet, "Multi–Application Peripherals and Accessories," Publication S2098–0056–2, 1 p., Jun., 1994.

Simplex Time Recorder Company, Leaflet, "Multi–Application Peripherals and Accessories," Publication S2098–0055–4, 1 p., Feb., 1994.

*Primary Examiner*—Thomas Mullen
*Assistant Examiner*—Sihong Huang
*Attorney, Agent, or Firm*—Hamilton, Brook, Smith & Reynolds, P.C.

[57] ABSTRACT

A smoke detection unit has a detection chamber for sampling smoke from a surrounding environment. The detection chamber allows air circulation but is optically opaque. This configuration is typical of photoelectric smoke detectors, for example. A housing defines a window though which air from the environment circulates into and out of the detection chamber. The window's height is approximately the same as the chamber. A cage vane is positioned in the window and is configured as an inverted frustoconical member. An inner edge of the cage vane is spaced away from the chamber. The angled vane, along the other aspects of the unit's configuration, improves sensitivity by increasing smoke circulation through the chamber. This configuration guides the air currents typically created by fires at the ceiling so that the smoke flows easily into the detection chamber.

20 Claims, 5 Drawing Sheets

U.S. PATENT DOCUMENTS

| | | | |
|---|---|---|---|
| D. 339,756 | 9/1993 | Igarashi et al. | D10/104 |
| D. 339,998 | 10/1993 | Igarashi et al. | D10/104 |
| D. 340,201 | 10/1993 | Fenne et al. | D10/104 |
| D. 340,416 | 10/1993 | Fenne | D10/104 |
| D. 340,659 | 10/1993 | Fenne | D10/104 |
| D. 342,213 | 12/1993 | Fellmann | D10/104 |
| D. 355,386 | 2/1995 | Fellmann | D10/104 |
| D. 355,862 | 2/1995 | Tice et al. | D10/104 |
| D. 357,202 | 4/1995 | Ozawa | D10/104 |
| D. 357,203 | 4/1995 | Ozawa | D10/104 |
| D. 361,732 | 8/1995 | Fischette et al. | D10/104 |
| 4,168,438 | 9/1979 | Morisue | 340/630 |
| 4,851,819 | 7/1989 | Kawai et al. | 340/628 |
| 5,546,074 | 8/1996 | Bernal et al. | 340/693 |
| 5,568,133 | 10/1996 | Durrer et al. | 340/693 |

SMOKE DETECTOR HOUSING FOR IMPROVED SMOKE COLLECTION

BACKGROUND OF THE INVENTION

Smoke detection systems generally fall into one of two categories: sensor-type systems and detector-type systems. In sensor systems, each detection unit samples the smoke in the surrounding atmosphere and sends a signal, indicative of the smoke level, back to a central office. The central office compares the sampled smoke level to a running average for the detection unit and, based upon the difference, determines whether or not to set an alarm condition. Detector-type systems also sample the environmental smoke at detection units. Rather than transmit the amount of detected smoke back to a central station, the detection unit itself makes the decision whether or not an alarm condition should be set. An alarm signal may then be passed to other detection units or to a central station.

The smoke detection units rely on one of a number of different principles to sample the environmental smoke. In ionization-type detection units, an isotope radiation source ionizes air samples between two plates, which are held at different potentials. The current flow between the two plates is then indicative of the smoke density. Photoelectric smoke detection units sample smoke by detecting the changes in the propagation of light through the sample. Scattering-type photoelectric units have a light source and a light sensitive device that are located in a detection chamber, through which environmental air may circulate but from which environmental light is blocked. The light source is oriented so that light will only reach the light sensitive device if it is scattered by smoke. In attenuation-type photoelectric smoke detection units, the light emitting diode and light sensitive diode face each other. The level of smoke in the atmosphere is a function of the attenuation of the light reaching the light sensitive diode.

Detection units typically comprise two main components. A smoke chamber and electronics to sample the environment and generate the associated data. For example, the chamber includes the light emitting and sensing devices in the photoelectric smoke detection unit. A housing surrounds the chamber/electronics and is typically ornamental in design.

The housings of many detection units simply have large windows that expose the smoke chamber to air circulation from the environment. While allowing good circulation, these designs do not hide the chamber or protect it from dirt or chemicals that may come from the work area below the detection unit. Some detection unit housings solve this problem by providing annular windows around the circumference of the unit with possibly a cage vane in this window so that the detection chamber is not directly viewable from the work area below.

SUMMARY OF THE INVENTION

The orientation of the cage vane and the size and placement of the window can affect the sensitivity of the detection unit in sensor-type, detector-type, or other related systems. By angling the cage vane so that it slopes downwardly at a set angle toward the smoke chamber, the sensitivity of the detection unit can be markedly improved by increasing smoke circulation through the chamber. This configuration guides the air and smoke currents, typically created by fires at the ceiling, so that the smoke flows into the detection chamber. The angling of the cage vane also tends to hide the chamber when the unit is mounted at standard ceiling height and viewed from the floor.

In general the invention features a smoke detection unit. The unit has a detection chamber for sampling smoke from a surrounding environment. A housing for the chamber defines a window though which air from the environment circulates into and out of the chamber. A cage vane is positioned in the window and is configured as an inverted frustoconical member.

In preferred embodiments, the chamber is surrounded by labyrinth vanes to render it optically opaque. An inner edge of the cage vane is spaced away from these labyrinth vanes so that the cage vane does not block off the chamber. This spacing should be at least 0.1 inches.

A height of the window should also be approximately equal to a height of the labyrinth vanes of the detection chamber. In particular, the heights of the window and of the labyrinth are approximately equal to 0.5 inches in the preferred configuration.

Further, the top surface of the cage vane should be angled from 15 to less than 25 degrees from horizontal. Approximately 20 degrees from horizontal is considered to be optimal both from the standpoint of smoke collection and hiding the labyrinth vanes. Also, the radial width of the cage vane should be approximately equal to a height of the window, i.e., about 0.5 inches, to help hide the labyrinth vanes. The distance between an inner edge of the cage vane and an outer edge of the labyrinth vanes of the detection chamber may be approximately equal to a height of the window, about 0.5 inches.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are to scale to illustrate the principles of the invention. Of the drawings.

DETAILED DESCRIPTION OF THE PREFERRED EMBODIMENTS

Figure 1:
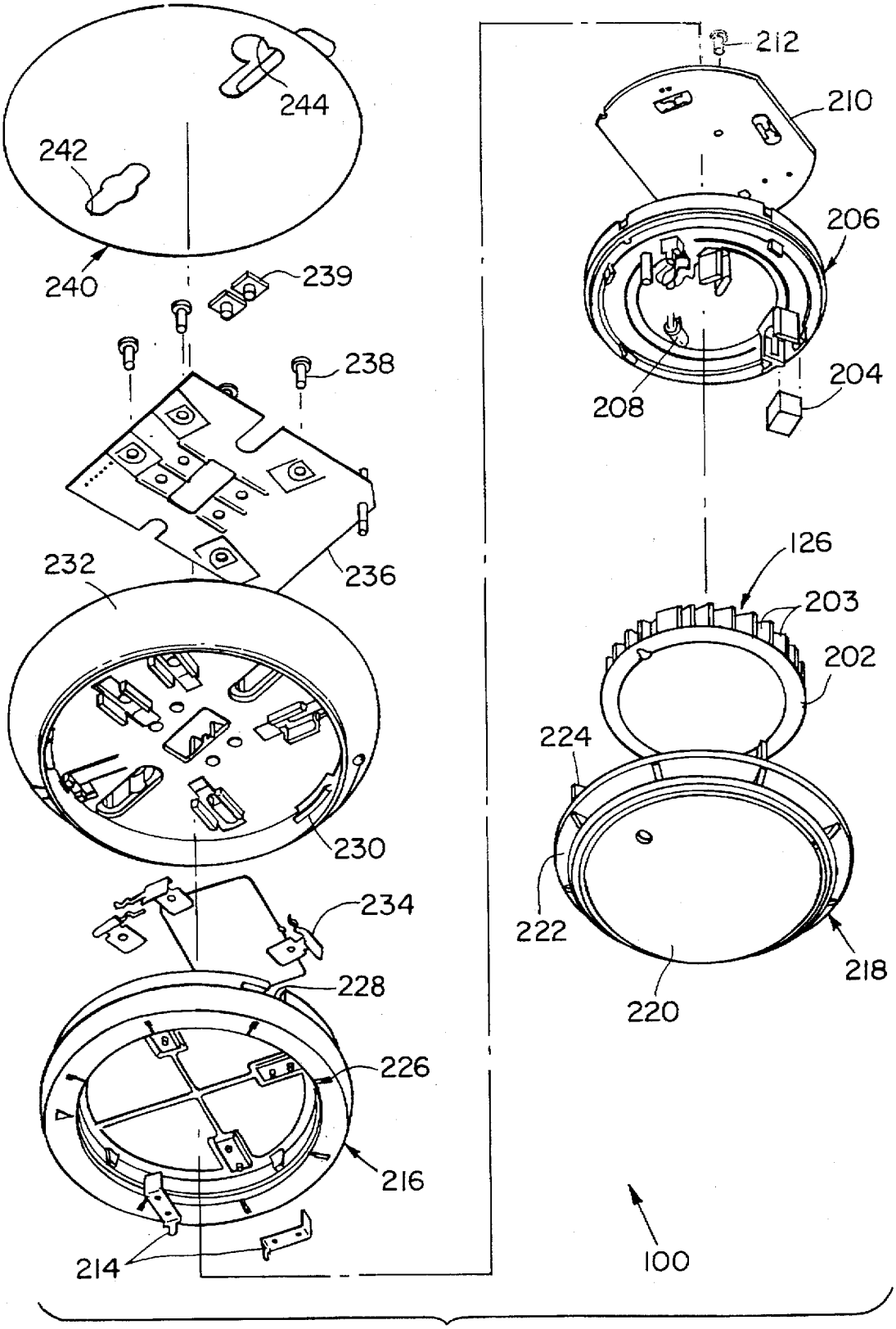
FIG. 1 is a perspective exploded view of a smoke detection unit of the present invention.

FIG. 1 is an exploded view of a smoke detection unit 100 embodying the principles of the present invention. A smoke chamber cover 202 secures to a smoke chamber base 206 to define the smoke chamber 126 therebetween. Labyrinth vanes 203 extend upwardly from the cover 202 to the base 206 to allow air from the environment to circulate through the chamber 126 while making the chamber optically opaque. Typically, an insect screen, not shown, extends around the outer circumference of the labyrinth vanes 203.

A light emitting diode 208 is secured to the chamber base 206. A prism 204 may be used to reflect scattered light from the light emitting diode 208 down to a photo sensitive device, such as a diode not shown, that is preferably located directly on a smoke chamber printed circuit board assembly 210. The printed circuit board assembly 210 is secured by bolt 212 to the smoke chamber base 206.

The smoke chamber base 206 snap fits into a cage retainer 216. Electrodes 214 extend from the cage retainer 216 to make electrical contact with the printed circuit board assembly 210.

A cage and top assembly 218 of the housing attaches to the cage retainer 216 to enclose the smoke chamber base and cover 206,202. In more detail, a cage vane 222 is supported above the cage cover 220 by legs 224. Some of legs 224 have hooked ends that extend through openings 226 in the cage retainer 216 so that the cage and top assembly 218 snap fits to the cage retainer 216.

The cage retainer 216 uses a bayonet-type attachment method to an analog base 232. Specifically, grooves 228 cooperate with ridges 230 on an inner circumference of the analog base 232 so that when properly aligned, the cage retainer 216 fits in the analog base 232 and then is secured by rotating the retainer 216 clockwise. Electrical connectors 234 engage posts, not shown, that extend from the bottom side of the analog base 232 to provide electrical conductivity between an analog base PC board assembly 236, housed in the analog base 232, and the PC board assembly 210 in the chamber base 206. The analog base PC board 236 is secured to the analog base by bolts 238. A communication wires to a central office connect to the analog base PC board at terminals 239.

A base cover 240 is secured to the analog base 232. Cutouts 242 are provided in the base that cooperate with hook members of a ceiling fixture, not shown, to allow the detection unit 100 to be hung from the ceiling.

Figure 2:
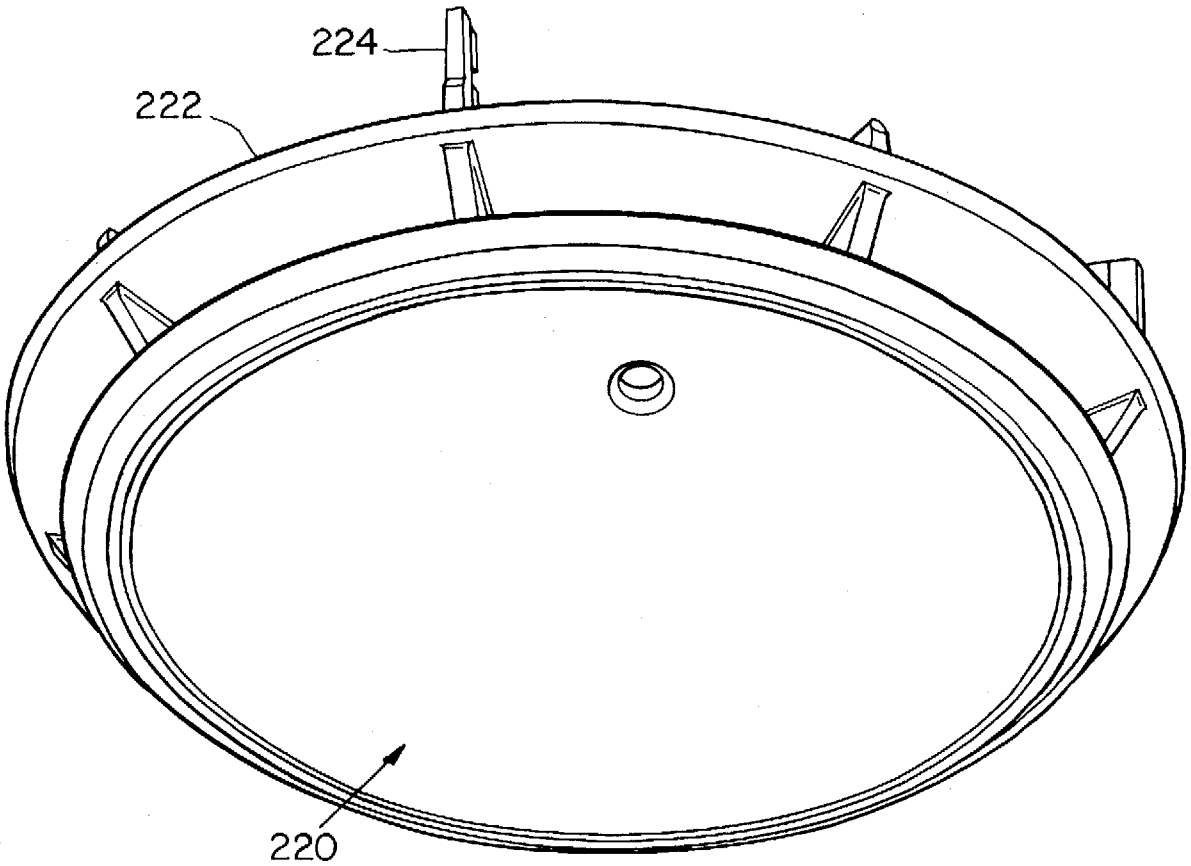
FIG. 2 is a perspective view of the cage and top assembly of the smoke detection unit housing of the present invention.

FIG. 2 is a more detailed diagram of the cage and top assembly 218 which forms the lower portion of the housing. This shows the cage cover 220, legs 224, and cage vane 222. The cage vane 222 is frustoconical and inverted, i.e., the large outer diameter is above the smaller inner diameter.

Figure 3:
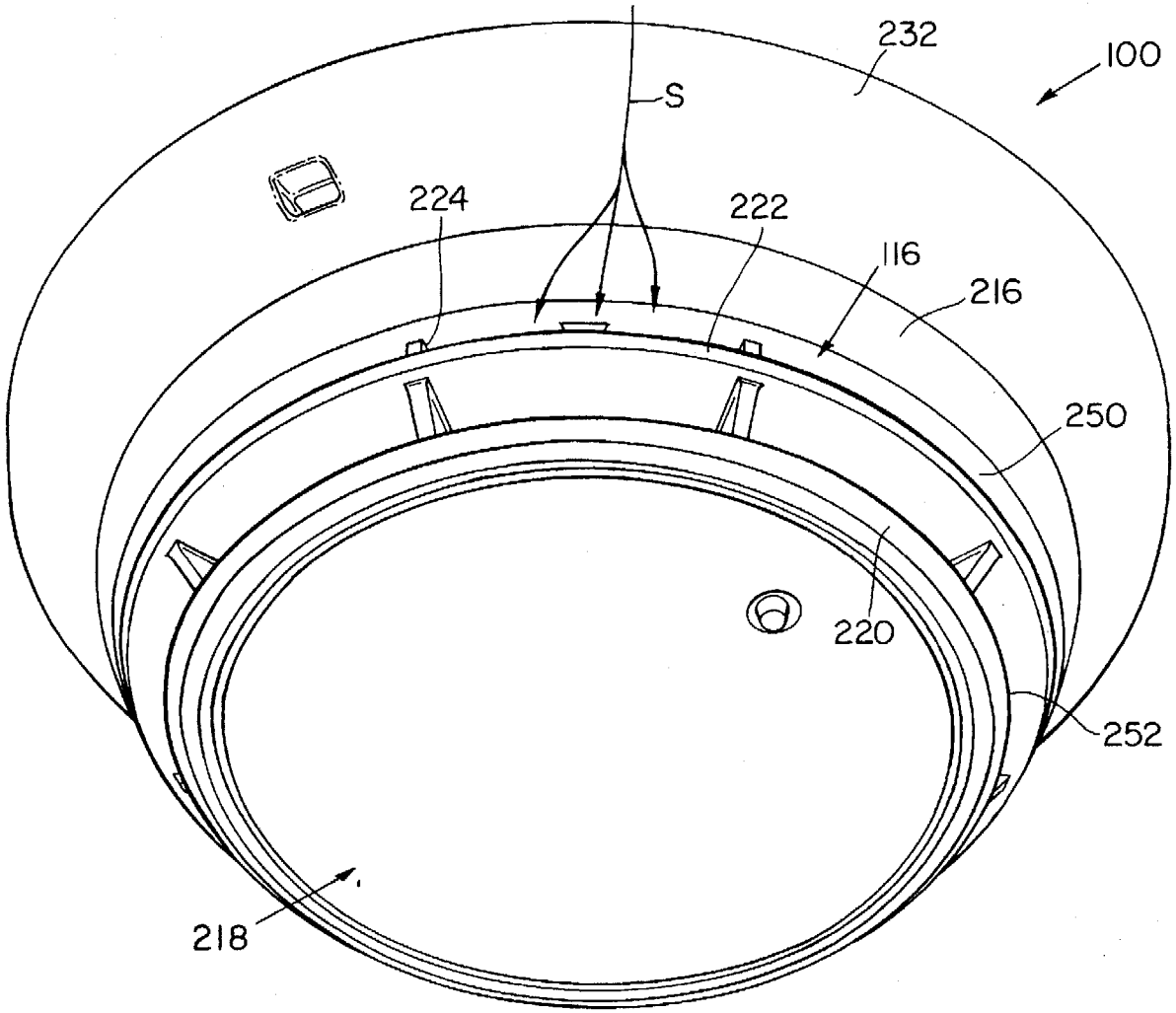
FIG. 3 is a perspective view of the complete inventive detection unit housing.

FIG. 3 shows the entire outer housing of the assembled smoke detection unit 100. The cage and top assembly 218 is fit onto the cage retainer 216. And the cage retainer is connected to the analog base 232. Smoke enters the smoke chamber via window 116 that extends between the lower extent 250 of the cage retainer 216 and the top edge 252 of the cage cover 220.

Figure 4:
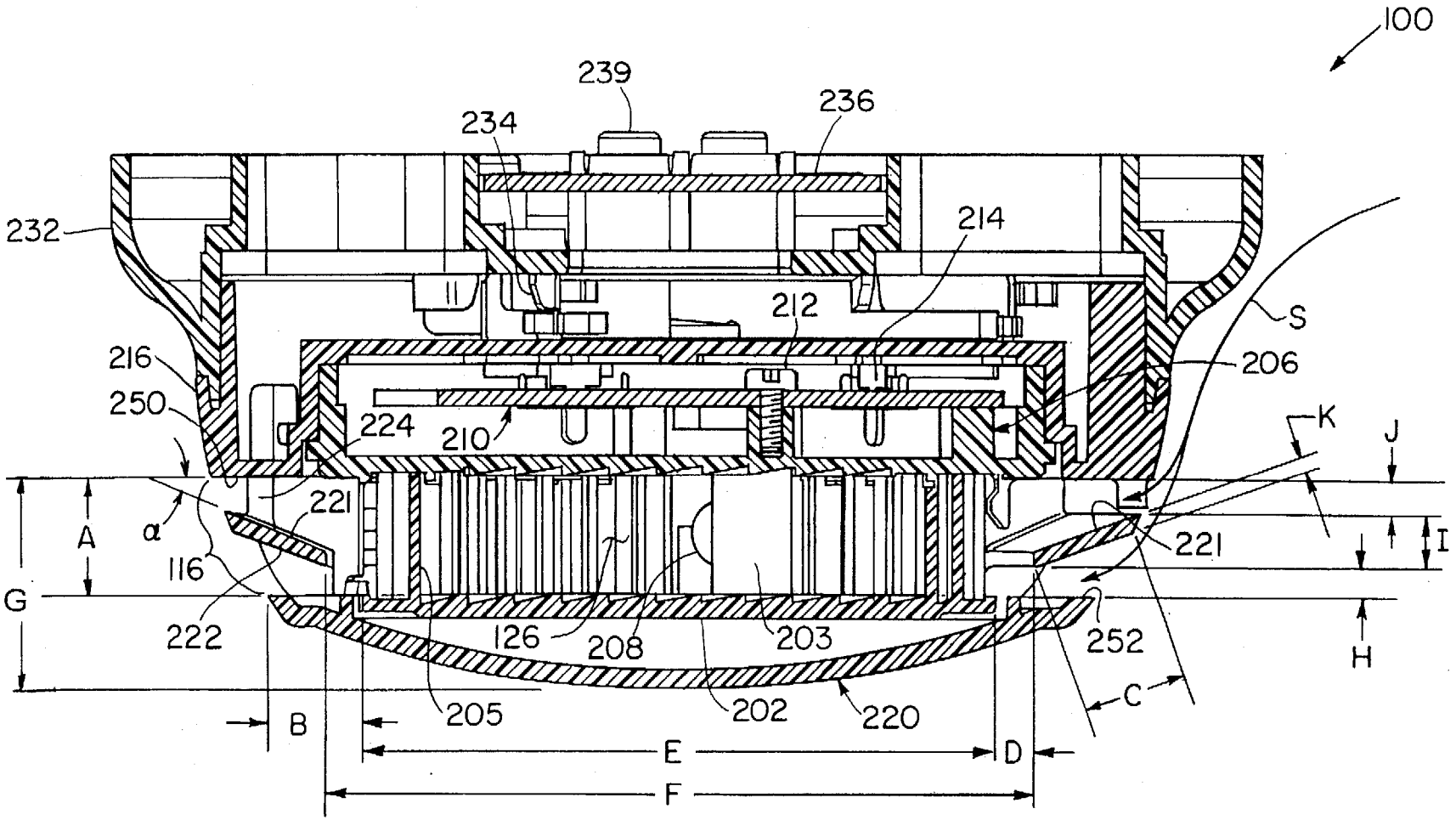
FIG. 4 is a cross-sectional view of the smoke detection unit of the present invention.

FIG. 4 is a cross sectional view of the assembled smoke detection unit 100 showing the path by which smoke enters the smoke chamber via the window 116. The figure shows a number of dimensional parameters.

Figure 5:
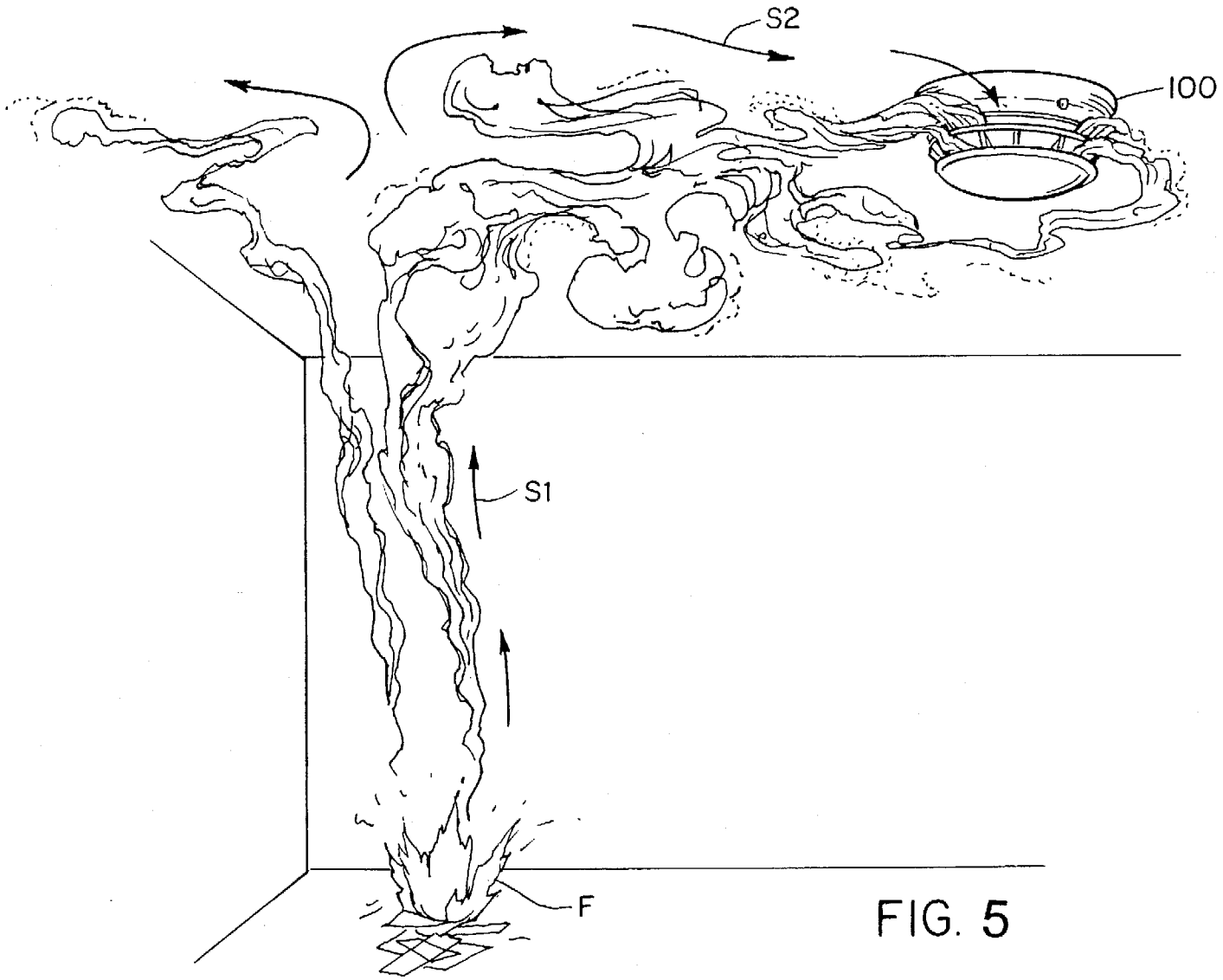
FIG. 5 is a perspective view showing the movement of heated air and smoke upward from a fire and then across the ceiling in a rolling motion.

The configuration of the window 116, the location of the window relative to the outer edge of the labyrinth vanes 203 of the smoke chamber 126, and configuration of the cage vane 222 affect the efficiency with which smoke is directed through the smoke chamber 126. As shown in FIG. 5, smoke and heated air S1 rise in a column from a fire F because the density is less than the surrounding cooler air. When this column reaches the ceiling, the smoke S2 dissipates radially away from the column, moving across the ceiling in a rolling motion.

When the spreading smoke reaches the fire detection unit 100 the fluid dynamics tend to cause the smoke to flow both around and under the detection unit 100. As shown by the arrows S in FIGS. 3 and 4, the smoke S flows down the outer sidewall of the base analog 232 and cage retainer 216 and in through the window 116.

In the present invention, the cage vane 222 is inverted frustoconical so that the top edge 221 slopes downwardly and inwardly from the outer housing of the smoke detection unit 100. As result, the smoke and heated air are directed into the smoke chamber 126. Experimentation has shown that the angle $\alpha$ of the cage vane should be 15°–20 ° from horizontal for best smoke collection efficiency. If the slope of the vane is 25° or greater, then the window becomes substantially closed to the smoke and the smoke tends to continue flowing over the bottom face of the detection unit 100 rather than being captured and directed into the chamber 126.

The sloping cage vane 222 also efficiently hides the smoke chamber labyrinth vanes 203 from view from the work area. The housing of the detection unit 100 is usually light in color so that it blends in with ubiquitous white ceiling tiles. The labyrinth vanes 203, however, are typically manufactured from a black plastic since, at least in scattering-type detectors, the inner surfaces of the detection chamber 126 must be light absorbent. Thus, the cloaking of the smoke chamber by the cage vane 222 improves the overall visual appeal of the detection unit 100. From the comparison of various designs, it has been discovered that an angle $\alpha$ of less than 15° tends to expose the labyrinth vanes 203. From the perspective of most viewing angles, 20° or greater work the best. Thus the cage vane 222 is 20° from horizontal to achieve the best combined smoke detection and smoke chamber shielding.

The vertical size A of the window 116 also has an effect on the smoke collection efficiency of the detection unit 100. The total window height, the distance between the bottom edge 250 of the cage retainer and the top edge of the cage cover, should be approximately equal to the height of the labyrinth vanes 203. In the preferred embodiment, both heights are equal to 0.49 inches (in.).

The depth B of the window 116, or the lateral distance between the outer edge of the cage cover 220 and the outer edge of the labyrinth vanes 203, is important to the cloaking of the labyrinth vanes 203. This distance is also substantially equal to the width C of the vane 222. The distance must be long enough so that labyrinth vanes 203 are not viewable from the work area. The length, however, must not be so long as to present a large resistance to the flow of air into the smoke chamber 126. An approximately 1:1 ratio between the height of the window A and the depth B represents an acceptable trade-off. In the present example, depth B is approximately equal to 0.45 in. which approximates the height A of the window (0.49 in.), and the depth of the vane (C=0.43 in.).

Finally, there should be a gap D between the inner edge of the vane 222 and the outer extent of the labyrinth vanes. This gap D allows the efficient circulation of air into the chamber 126. The gap is preferably 0.16 in. If there is no gap, the inner edge of the cage vane 222 tends to block off a portion of the air flow through labyrinth vanes impeding the flow of air into the smoke chamber. This is due to the fact that the cage vane 222 has a thickness K=0.060 in.

The other dimensions of the smoke vanes are as follows. The outer diameter E of the labyrinth vanes of the smoke chamber 126 is 2.71 in. An inner diameter F of the cage vane 222 is 3.03 in. The vertical distance G between the lower edge 250 of the cage retainer 216 and the bottom extent of cover 220 is 0.88 in. A gap H between the lower inner edge of the cage vane 222 and the top edge 252 of the cap cover is 0.12 in. The vertical height I of the cage vane is 0.22 in., and the gap J between the upper edge of the cage vane 222 and the top extent of the window 116 is 0.14 in.

While this invention has been particularly shown and described with references to preferred embodiments thereof, it will be understood by those skilled in the art that various changes in form and detail may be made therein without departing from the spirit and scope of the invention as defined by the appended claims.

What is claimed is:

1. A smoke detection unit comprising:

a detection chamber which samples smoke from a surrounding environment;

a housing for the detection chamber, comprising a cover and a base, the cover being supported below and spaced away from the base to define a window though which air from the environment circulates into and out of the detection chamber; and an inverted frustoconical cage vane positioned in the window, between the cover and base, the cage vane having a downwardly sloping top edge to guide smoke through the window to the detection chamber.

2. A smoke detection unit as described in claim 1, wherein the detection chamber is surrounded by labyrinth vanes that are substantially optically opaque but open to air circulation.

3. A smoke detection unit as described in claim 2, wherein a height of the window is approximately equal to a height of the labyrinth vanes.

4. A smoke detection unit as described in claim 2, wherein heights of the window and of the labyrinth vanes of the detection chamber are approximately equal to 0.5 inches.

5. A smoke detection unit as described in claim 2, wherein a distance between an outer edge of the cage vane and an outer edge of the detection chamber is approximately equal to a height of the window.

6. A smoke detection unit as described in claim 2, wherein a distance between an outer edge of the cage vane and an outer edge of the side wall of the detection chamber is approximately equal to 0.5 inches.

7. A smoke detection unit as described in claim 1, wherein the cage vane is angled at approximately 15° or greater but less than 25° from horizontal.

8. A smoke detection unit as described in claim 1, wherein the cage vane is angled at approximately 20 degrees from horizontal.

9. A smoke detection unit as described in claim 1, wherein a radial width of the cage vane is approximately equal to a height of the window.

10. A smoke detection unit as described in claim 1, wherein a radial width of the cage vane is approximately equal to 0.5 inches.

11. A smoke detection unit, comprising:

a detection chamber which samples smoke from a surrounding environment;

labyrinth vanes, surrounding the detection chamber, which are substantially optically opaque but open the detection chamber to air circulation;

a housing for the detection chamber, which defines a window though which air from the environment circulates through the labyrinth vanes and into and out of the detection chamber; and an inverted frustoconical cage vane which is positioned in the window and has an inner edge that is spaced away from an outer surface of the labyrinth vanes of the detection chamber.

12. A smoke detection unit as described in claim 11, wherein the inner edge of the cage vane is at least 0.1 inches from an outer edge of the labyrinth vanes.

13. A smoke detection unit comprising:

a smoke chamber defined by labyrinth vanes that are optically opaque but allow air to circulate through the chamber;

a housing for the smoke chamber, which defines a window that is approximately equal to a height of the labyrinth vanes of the smoke chamber and though which air from the environment circulates into and out of the smoke chamber; and an inverted frustoconical cage vane positioned in the window and having inner edge that is spaced away from an outer edge of the labyrinth vanes.

14. A smoke detection unit as described in claim 13, wherein the inner edge of the cage vane is at least 0.1 inches from an outer edge of the labyrinth vanes.

15. A smoke detection unit as described in claim 13, wherein heights of the window and of the labyrinth vanes of the smoke chamber are approximately equal to 0.5 inches.

16. A smoke detection unit as described in claim 13, wherein the top surface of the cage vane is angled at 15° or greater but less than 25° degrees from horizontal.

17. A smoke detection unit as described in claim 13, wherein the top surface of the cage vane is angled at approximately 20 degrees from horizontal.

18. A smoke detection unit as described in claim 13, wherein a radial width of the cage vane approximately equal to 0.5 inches.

19. A smoke detection unit as described in claim 13, wherein a distance between an outer edge of the cage vane and an outer edge of the labyrinth vanes of the smoke chamber is approximately equal to a height of the window.

20. A smoke detection unit as described in claim 13, wherein a distance between an outer edge of the cage vane and an outer edge of the labyrinth vanes of the smoke chamber is approximately equal to 0.5 inches.

* * * * *

UNITED STATES PATENT AND TRADEMARK OFFICE

CERTIFICATE OF CORRECTION

PATENT NO. : 5,751,218

DATED : May 12, 1998

INVENTOR(S) : Winterble et al.

It is certified that error appears in the above-identified patent and that said Letters Patent is hereby corrected as shown below:

Claim 1, column 5, line 18, "though" should be --through--.

Claim 11, column 6, line 7, "though" should be --through--.

Claim 13, column 6, line 24, "though" should be --through--.

Signed and Sealed this

First Day of September, 1998

*Attest:*

Bruce Lehman

BRUCE LEHMAN

*Attesting Officer*

*Commissioner of Patents and Trademarks*